US008950140B1

(12) United States Patent
Katwyk

(10) Patent No.: US 8,950,140 B1
(45) Date of Patent: Feb. 10, 2015

(54) DIMENSIONAL TILE BACKING

(71) Applicant: Dimensional Tile Backer, LLC, Park City, UT (US)

(72) Inventor: Rodney James Katwyk, South Jordan, UT (US)

(73) Assignee: Dimensional Tile Backer, LLC, Park City, UT (US)

( * ) Notice: Subject to any disclaimer, the term of this patent is extended or adjusted under 35 U.S.C. 154(b) by 0 days.

(21) Appl. No.: 14/133,164

(22) Filed: Dec. 18, 2013

Related U.S. Application Data

(60) Provisional application No. 61/865,058, filed on Aug. 12, 2013.

(51) Int. Cl.
*E04F 13/08* (2006.01)

(52) U.S. Cl.
CPC ..... *E04F 13/0862* (2013.01); *E04F 13/08* (2013.01)
USPC ..... 52/385; 52/309.8; 52/311.2

(58) Field of Classification Search
USPC ..... 52/309.4, 309.8, 309.9, 560, 535, 518, 52/311.1, 311.2, 311.3, 314, 64, 71, 384, 52/385, 386
See application file for complete search history.

(56) References Cited

U.S. PATENT DOCUMENTS

| | | | | | |
|---|---|---|---|---|---|
| 2,935,152 | A | * | 5/1960 | MacCaferri | 181/290 |
| 3,681,881 | A | * | 8/1972 | Baran | 52/29 |
| RE27,502 | E | * | 10/1972 | Martin | 52/94 |
| 3,817,012 | A | * | 6/1974 | Wack et al. | 52/315 |
| 3,826,054 | A | * | 7/1974 | Culpepper, Jr. | 52/309.8 |
| 3,897,667 | A | * | 8/1975 | Turek | 52/546 |
| 4,033,802 | A | * | 7/1977 | Culpepper et al. | 156/71 |
| 4,320,613 | A | * | 3/1982 | Kaufman | 52/521 |
| 4,399,643 | A | * | 8/1983 | Hafner | 52/530 |
| 4,506,486 | A | * | 3/1985 | Culpepper et al. | 52/529 |
| 4,642,950 | A | * | 2/1987 | Kelly | 52/90.2 |
| 4,788,808 | A | * | 12/1988 | Slocum | 52/521 |
| 4,926,611 | A | * | 5/1990 | Funaki | 52/748.1 |
| 4,969,302 | A | * | 11/1990 | Coggan et al. | 52/309.8 |
| 5,016,415 | A | * | 5/1991 | Kellis | 52/522 |
| 5,140,789 | A | * | 8/1992 | De Gooyer | 52/71 |
| 5,222,337 | A | * | 6/1993 | Thomsen et al. | 52/404.1 |
| 5,502,940 | A | * | 4/1996 | Fifield | 52/309.12 |
| 5,560,173 | A | * | 10/1996 | Scheiwiller | 52/608 |
| 5,575,125 | A | * | 11/1996 | Lalvani | 52/311.2 |
| 5,598,677 | A | * | 2/1997 | Rehm, III | 52/407.1 |

(Continued)

FOREIGN PATENT DOCUMENTS

| | | |
|---|---|---|
| CN | 2816205 | 9/2006 |
| EP | 1592328 B1 | 11/2005 |

(Continued)

*Primary Examiner* — James Ference
(74) *Attorney, Agent, or Firm* — Kunzler Law Group

(57) ABSTRACT

A system for mounting tile relative to a flat surface may include a plurality of tiles and support structure to be mounted to the flat surface. The support structure may have a plurality of support surfaces on which the tiles are mounted such that the tiles are at different angles and/or heights relative to the flat surface. The support surfaces may be arranged in a wide variety of patterns, and may have shapes that correspond to those of the tiles. The tiles and support surfaces may have a wide variety of shapes. The support structure may be a single piece on which all of the support surfaces are formed, or may be created through the assembly of multiple support blocks, each of which has one or more of the support surfaces thereon.

3 Claims, 8 Drawing Sheets

(56) References Cited

U.S. PATENT DOCUMENTS

| | | | | |
|---|---|---|---|---|
| 5,775,040 | A * | 7/1998 | Lalvani | 52/311.2 |
| 5,966,883 | A * | 10/1999 | Krusec et al. | 52/302.1 |
| 6,029,415 | A * | 2/2000 | Culpepper et al. | 52/522 |
| 6,105,324 | A * | 8/2000 | Krusec et al. | 52/302.1 |
| 6,195,952 | B1 * | 3/2001 | Culpepper et al. | 52/522 |
| 6,263,574 | B1 * | 7/2001 | Lubker et al. | 29/897.32 |
| 6,308,485 | B1 | 10/2001 | Blumenthal | |
| 6,321,500 | B1 * | 11/2001 | Manning et al. | 52/555 |
| 6,415,570 | B1 * | 7/2002 | Wentz | 52/302.1 |
| 6,526,718 | B2 * | 3/2003 | Manning et al. | 52/555 |
| 6,581,348 | B2 * | 6/2003 | Hunter, Jr. | 52/408 |
| 6,782,670 | B2 * | 8/2004 | Wendt | 52/506.07 |
| 6,948,288 | B1 * | 9/2005 | Smith | 52/409 |
| 7,040,067 | B2 * | 5/2006 | Mowery et al. | 52/519 |
| 7,188,454 | B2 * | 3/2007 | Mowery et al. | 52/539 |
| 7,493,734 | B2 | 2/2009 | Kramer | |
| 8,096,093 | B1 | 1/2012 | Poon | |
| 8,298,044 | B2 | 10/2012 | Spurgeon | |
| 8,438,813 | B2 | 5/2013 | Cordeiro | |
| 2002/0076544 | A1 | 6/2002 | DeWorth et al. | |
| 2005/0081468 | A1 * | 4/2005 | Wilson et al. | 52/528 |
| 2006/0053715 | A1 * | 3/2006 | Mowery et al. | 52/309.8 |
| 2006/0075712 | A1 * | 4/2006 | Gilbert et al. | 52/520 |
| 2006/0137279 | A1 | 6/2006 | Smith | |
| 2007/0011976 | A1 * | 1/2007 | Mowery et al. | 52/506.01 |
| 2007/0193177 | A1 * | 8/2007 | Wilson et al. | 52/518 |
| 2008/0016813 | A1 * | 1/2008 | Fujii | 52/519 |
| 2008/0187739 | A1 * | 8/2008 | Baker et al. | 428/297.7 |
| 2008/0216430 | A1 * | 9/2008 | Gleeson et al. | 52/506.1 |
| 2009/0038252 | A1 * | 2/2009 | King | 52/506.05 |
| 2009/0277113 | A1 * | 11/2009 | Taraba et al. | 52/302.1 |
| 2010/0319288 | A1 * | 12/2010 | Morse et al. | 52/518 |
| 2011/0047695 | A1 * | 3/2011 | Niedens | 4/679 |
| 2013/0071625 | A1 | 3/2013 | Masanek, Jr. et al. | |

FOREIGN PATENT DOCUMENTS

| | | | |
|---|---|---|---|
| EP | 2232190 | B1 | 9/2010 |
| JP | 084244 | | 1/1996 |
| JP | 2007231647 | | 9/2007 |
| WO | 97/40240 | A1 | 10/1997 |

* cited by examiner

DIMENSIONAL TILE BACKING

CROSS-REFERENCE TO RELATED APPLICATIONS

The present application claims the benefit of U.S. Provisional Patent Application Ser. No. 61/865,058, entitled DIMENSIONAL TILE BACKING, filed Aug. 12, 2013. The foregoing application is incorporated by reference as though set forth herein in its entirety.

BACKGROUND

Tile is used in a wide variety of residential and commercial settings including kitchens, bathrooms, entryways, foyers, fireplaces, accent walls, and the like. Tile may present a surface with colors and/or patterns that uniquely complement the other colors and/or shapes used in a given space. However, known applications of tile are typically relatively two-dimensional. Most frequently, the flat surface of a floor, wall, or ceiling is simply covered in tile, leaving a flat and relatively featureless surface. Even tiled three-dimensional shapes, such as shower benches, possess only a very basic shape (i.e., a rectangular prism) with large, flat surfaces that are devoid of any finer geometric detail.

It has been shown that the human eye is drawn not only by colors, but also by geometric variation. Accordingly, it would be an advancement in the art to provide tile applications that more effectively draw the eye and serve a higher ornamental function than known tile designs. Furthermore, it would be an advancement in the art to provide such tile applications with relatively low manufacturing and installation costs. Yet further, it would be an advancement in the art to provide such tile applications that can be used for a wide variety of situations and designs.

SUMMARY

The subject matter of the present application has been developed in response to the present state of the art, and in particular, in response to the problems and needs in the art that have not yet been fully solved by currently available tile systems. Accordingly, the subject matter of the present application has been developed to provide signage apparatus, methods, and systems that overcome at least some shortcomings of the prior art.

In one exemplary embodiment, a system may be provided for mounting a plurality of tiles on a flat surface. The system may include a plurality of tiles, each of which comprises a mounting surface and an exterior surface. The system may further include a support structure mountable on the flat surface. The support structure may include a plurality of support surfaces, each of which is shaped to underlie and support substantially the entire mounting surface of at least one of the plurality of tiles. The support structure may be shaped such that, after the support structure has been mounted on the flat surface, the support surfaces are, relative to the flat surface, positioned at a plurality of different heights and/or angles.

Each tile of the plurality of tiles may have a substantially uniform thickness that is the same for all of the tiles of the plurality of tiles. Each of the support surfaces may be approximately the same size and shape as one of the mounting surfaces such that, upon mounting of the mounting surface on the support surface, the support surface is substantially entirely covered by the corresponding tile.

The plurality of support surfaces may include a first support surface and a second support surface adjacent to and nonparallel to the first support surface. The second support surface may be oriented and positioned such that, across a plane perpendicular to the flat surface, the second support surface is substantially a minor image of the first support surface.

The plurality of support surfaces may further include a third support surface adjacent to the first support surface, and a fourth support surface adjacent to the second support surface and the third support surface. The fourth support surface may be oriented and positioned such that, across the plane, the fourth support surface is substantially a mirror image of the third support surface. The third support surface may be substantially parallel to the second support surface and the fourth support surface may be substantially parallel to the first support surface.

Each of the first and second support surfaces may have a parallelogram shape. Combined, the first and second support surfaces may define a chevron shape.

The support surfaces may be arranged in a two-dimensional array. Each of the support surfaces may have at least one shape selected from circles, squares, diamonds, rhomboid shapes, trapezoidal shapes, triangles, pentagons, hexagons, and octagons. Each of the support surfaces may, for example, have a hexagonal shape.

The support structure may be formed substantially of three-pound foam. The support structure may include a plurality of support blocks, each of which has one support surface of the plurality of support surfaces. Alternatively, the support structure may be formed as a single piece.

According to one example, a method according to the invention may include providing a plurality of tiles, each of which comprises a substantially uniform thickness that is the same for all of the tiles of the plurality of tiles. Each of the tiles may have a mounting surface and an exterior surface. The method may further include providing a support structure with a plurality of support surfaces, mounting the support structure to a flat surface, and mounting the mounting surfaces of the tiles to the support surfaces of the support structure such that the exterior surfaces are positioned, relative to the flat surface, at a plurality of different heights and/or angles.

Mounting the mounting surfaces of the tiles to the support surfaces of the support structure may include causing each support surface to underlie substantially all of the corresponding tile. Mounting the mounting surfaces of the tiles to the support surfaces of the support structure may further include substantially entirely covering each support surface with the corresponding tile.

Providing the plurality of tiles may include providing a first tile with a first exterior surface and a second tile with a second exterior surface. The plurality of support surfaces may include a first support surface and a second support surface. Mounting the mounting surfaces of the tiles to the support surfaces of the support structure may include mounting the first tile to the first support surface, and mounting the second tile to the second support surface adjacent to the first tile such that the second exterior surface is oriented nonparallel to the first exterior surface. The second exterior surface may then have a second position and a second orientation that substantially minor, across a plane perpendicular to the flat surface, a first position and a first orientation of the first exterior surface.

Providing the plurality of tiles may further include providing a third tile with a third exterior surface and a fourth tile with a fourth exterior surface. The plurality of support surfaces may further include a third support surface and a fourth support surface. Mounting the mounting surfaces of the tiles to the supporting surfaces of the support structure may further include mounting the third tile to the third support surface adjacent to the first tile such that the third exterior surface is parallel to the second exterior surface, and mounting the fourth tile to the fourth support surface adjacent to the second tile and the third tile such that the fourth exterior surface is parallel to the first exterior surface and the fourth exterior surface is in a fourth position and a fourth orientation that substantially mirror, across the plane, a third position and a third orientation of the third exterior surface.

Each of the first and second support surfaces may have a parallelogram shape. Mounting the second tile to the second support surface may include positioning the second exterior surface to define, in combination with the first exterior surface, a chevron shape.

Mounting the mounting surfaces of the tiles to the support surfaces may include arranging the tiles in a two-dimensional array. Providing the support structure may include providing a plurality of support blocks, each of which includes one support surface of the plurality of support surfaces. Mounting the support structure to a flat surface may include mounting the support blocks to the flat surface such that the support blocks are adjacent to each other. Providing the support structure may include forming the support surfaces in a single piece.

In another exemplary embodiment, a system may be provided for mounting a plurality of tiles on a flat surface. The system may include a plurality of tiles, each of which has a substantially uniform thickness that is the same for all of the tiles of the plurality of tiles. Each of the tiles may have a mounting surface and an exterior surface. The system may further include a support structure formed as a single piece from three-pound foam. The support structure may be mountable on the flat surface, and may include a plurality of support surfaces. Each of the support surfaces may be approximately the same size and shape as one of the mounting surfaces such that, upon mounting of the mounting surface on the support surface, each support surface underlies substantially all of the corresponding tile and is substantially entirely covered by the corresponding tile. The support structure may be shaped such that, after the support structure has been mounted on the flat surface, the support surfaces are, relative to the flat surface, positioned at a plurality of different heights and/or angles.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Exemplary embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the apparatus, system, and method of the present invention, as represented in FIGS. 1 through 8, is not intended to limit the scope of the invention, as claimed, but is merely representative exemplary of exemplary embodiments of the invention.

The phrases "connected to," "coupled to" and "in communication with" refer to any form of interaction between two or more entities, including mechanical, electrical, magnetic, electromagnetic, fluid, adhesive, and thermal interaction. Two components may be functionally coupled to each other even though they are not in direct contact with each other. The term "abutting" refers to items that are in direct physical contact with each other, although the items may not necessarily be attached together. The terms "mounted," "secured," "rigidly attached," and "fixedly attached" refer to items that are secured together so as to substantially prevent relative motion between the items.

Figure 1:
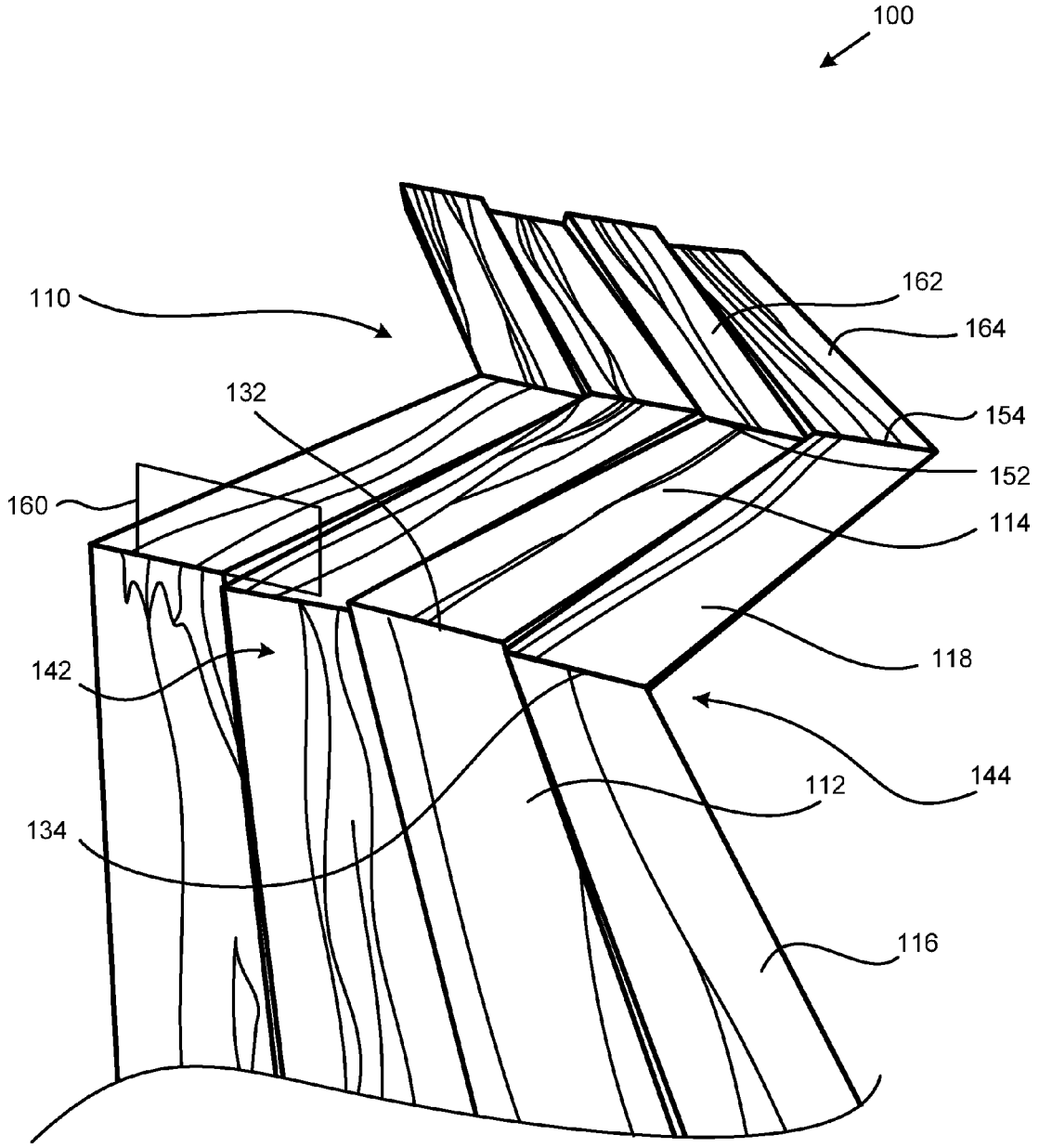
FIG. 1 is a perspective view of a system according to one embodiment of the invention.

Referring to FIG. 1, a perspective view illustrates a system 100 according to one embodiment of the invention. The system 100 may be a tile system designed to be mounted to a flat surface. The system 100 may be particularly useful for a vertical surface such as an interior wall of a structure. The system 100 may include geometric variations so that the outward-facing surfaces are not coplanar, as in most tile applications, but are contoured in three dimensions. The dimensional aspect of the system 100 may provide ornamental features particularly suited to walls where a visual accent is desirable, such as a fireplace surround, a lobby for a business, a molding segment, an accent wall, or the like.

The system 100 may include a plurality of tiles 110 including, for example, a first tile 112, a second tile 114, a third tile 116, and a fourth tile 118. The tiles 110 may be of any known type including ceramic, marble, stone, slate, granite, Formica, glass, mirror, leather, metal, wood, synthetics thereof, and/or combinations thereof.

The tiles 110 may be of a substantially uniform thickness, individually and/or collectively. Thus, the tiles 110 need not be formed with variable thickness to provide the ornamental, dimensional appearance of the system 100. Rather, the tiles 110 may be formed according to conventional processes and cut or otherwise divided into the shapes shown in FIG. 1.

The tiles 110 may be attached to a support structure 120 of the system 100, which is not visible in FIG. 1. The support structure 120 may have a variable thickness that provides a plurality of support surfaces, each of which has the proper position and angulation to support one of the tiles 110 to provide the pattern shown in FIG. 1. Thus, the dimensional aspect of the system 100 need not be provided by the tiles 110, but may instead be provided by the support structure 120. The manner in which this is accomplished will be shown and described in connection with FIGS. 3 and 4.

The tiles 110 of FIG. 1 may each have a generally parallelogram shape. Further, the tiles 110 may be patterned such that adjacent pairs of tiles define a chevron shape. More precisely, the first tile 112 and the second tile 114 may be shaped and positioned to be minor images of each other across a plane 160 passing through the junction 132 where the first tile 112 and the second tile 114 meet. Similarly, the third tile 116 and the fourth tile 118 may be shaped and positioned to be minor images of each other across the same plane, which also passes through the junction 134 where the third tile 116 an the fourth tile 118 meet.

The first tile 112 and the second tile 114, combined, may define a first chevron shape 142. The third tile 116 and the fourth tile 118, combined, may define a second chevron shape 144 similar to the first chevron shape 142. However, the first chevron shape 142 may be different from the second chevron shape 144 in that, in the first chevron shape 142, the junction 132 protrudes outward (i.e., away from the flat surface to which the system 100 will be mounted) relative to the ends of the first tile 112 and the second tile 114 that are furthest from the junction 132. In the second chevron shape 144, the junction 134 may be recessed inward, while the ends of the third tile 116 and the fourth tile 118 that are furthest from the junction 134 may protrude outward.

The tiles 110 may define a repeating pattern. Thus, for example, the end of the second tile 114 that is furthest from the junction 132 may define a junction 152 with a fifth tile 162. The first tile 112 and the fifth tile 162 may, combined, define another chevron shape in which the junction 152 is recessed like the junction 134 of the second chevron shape 144. Similarly, the end of the fourth tile 118 that is furthest from the junction 134 may define a junction 154 with a sixth tile 164. The fourth tile 118 and the sixth tile 164 may, combined, define another chevron shape in which the junction 154 protrudes like the junction 132 of the first chevron shape 142.

The repeating pattern defined by the tiles 110 may be a two-dimensional array, i.e., a set of tiles that are displaced from each other along two orthogonal axes (left-to-right and up-to-down relative to the view of FIG. 1). The support surfaces of the support structure 120 may define a corresponding two-dimensional array.

Tiles according to the invention may have any of a wide variety of shapes including, but not limited to, equilateral polygons, non-equilateral polygons, parallelograms, trapezoids, and the like. Furthermore, tiles according to the invention need not have only straight sides, but may additionally or alternatively include circular boundaries. Thus, tiles according to the invention may include shapes that are circles, sectorial portions of circles, French curves, other curves with constant or changing radii, and/or other shapes that include combinations of curves and straight segments. Tiles according to the invention may be arranged to form mosaic-type patterns according to a wide variety of schema known in the art.

Such patterns may include a wide variety of known repeating or non-repeating two-dimensional patterns. Such patterns may be provided with a three-dimensional aspect by recessing and/or lifting some shapes relative to others. The support structure may thus have a variable thickness that positions some tiles relatively further than others from the flat surface on which the system is mounted. This may be called "depth variation."

If desired, the tiles may be parallel to each other such that there is substantially no difference or distinctions in angular positioning between the tiles. Thus, the tiles may all face in substantially the same direction. Alternatively, the tiles may have "angular variation" in addition to or in place of the depth variation described above (the variation in the distance from the flat surface). Angular variation may include positioning of the tiles at different angles, or positioning of the tiles at the same angle, which is non-parallel to the flat surface to which they are mounted, so that the tiles are not coplanar.

The support structure may be designed with multiple support surfaces that are positioned at a variety of heights and/or angles to implement the desired depth variation and/or angular variation. The support structure may be all one piece, or may include multiple pieces, such as a separate piece with each support surface, thereby providing a separate piece for each of the tiles. If desired, some of the tiles may be mounted directly to the flat surface, while others are mounted to the support surface, to provide the desired depth and/or angular variation.

Returning to the exemplary embodiment of FIG. 1, the system 100 may include angular variation that positions the first tile 112 and the second tile 114 at angles that are mirror images to each other across the plane containing the junction 132. The first tile and the second tile 114 may each have the same average distance from the flat surface to which the system 100 is mounted, so there may be little or no depth variation in the system 100.

Figure 2:
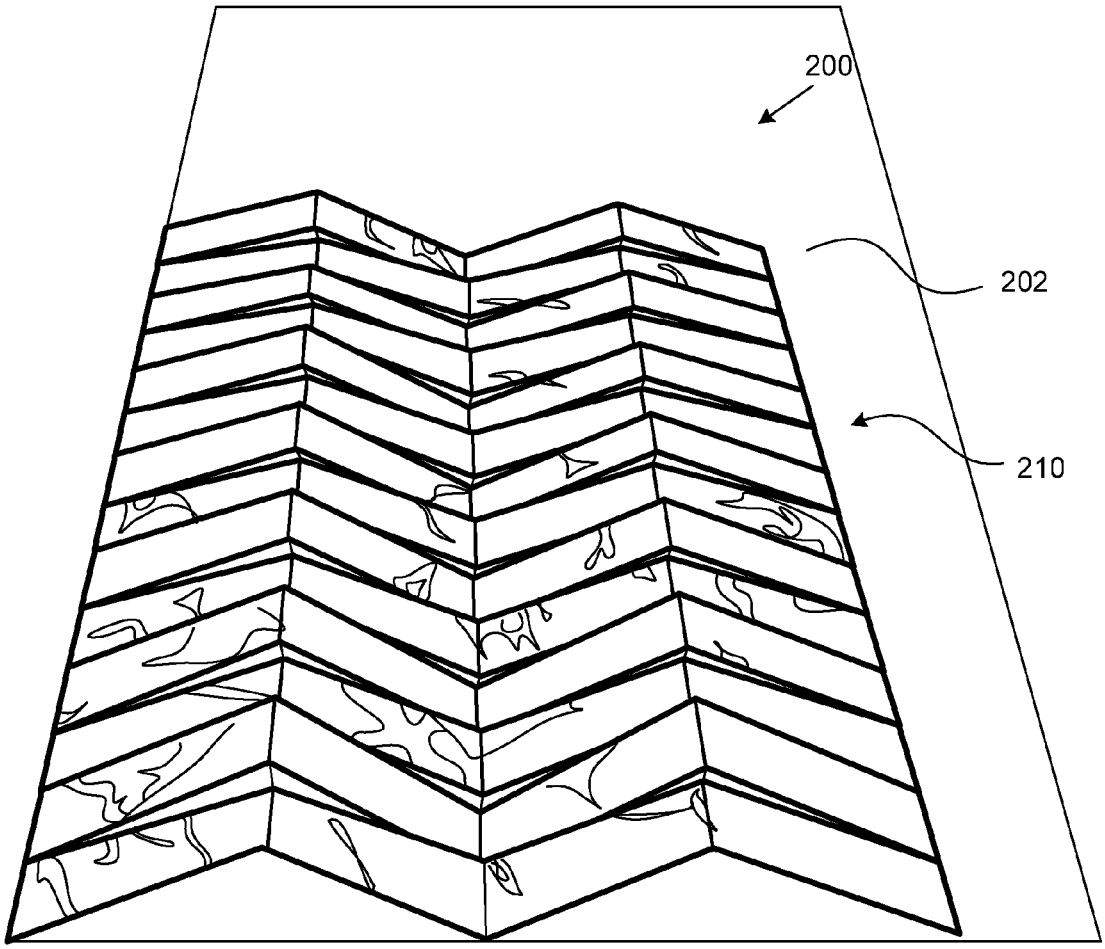
FIG. 2 is a perspective view of a system according to one alternative embodiment of the invention.

Referring to FIG. 2, a perspective view illustrates a system 200 according to one alternative embodiment of the invention. The system 200 may be similar to the system 100 in that the system 200 may incorporate a similar pattern of chevron shapes, but with a larger number of tiles 210. The tiles of the system 200 may be mounted on a support structure (not visible) with a larger number of support surfaces. The system 200 may be mounted to a flat surface 202 such as a wall. The tiles may be smaller than those of the system 100. Tiles according to the invention may have a wide variety of sizes.

Figure 3:
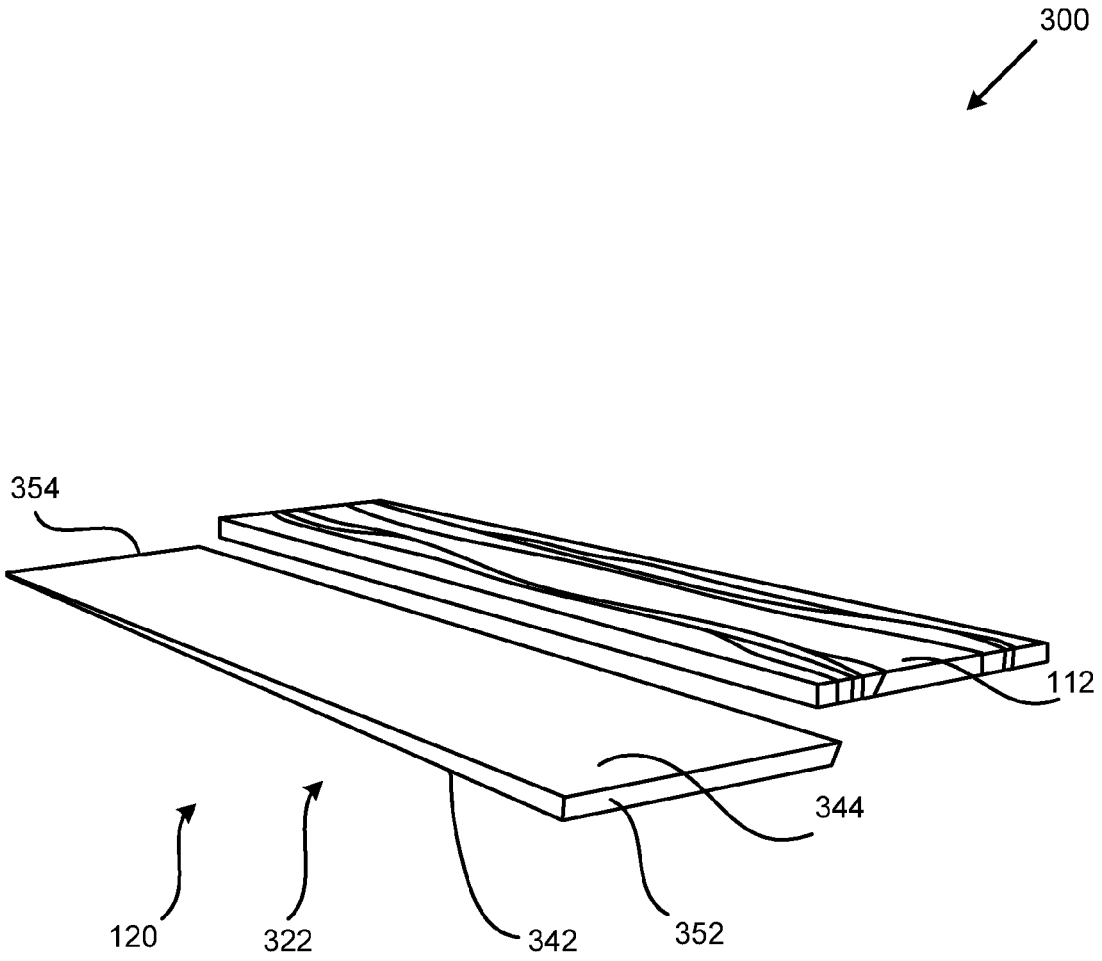
FIG. 3 is a perspective view of a portion of the system of FIG. 1 in a disassembled state.

Referring to FIG. 3, a perspective view illustrates a portion 300 of the system 100 of FIG. 1 in a disassembled state. More specifically, FIG. 3 illustrates the first tile 112 of the system 100 along with a portion of the support structure 120 that provides the angular variation of the tiles 110 of the system 100. The support structure 120 may include a plurality of segments including a first segment 322, as shown.

The first segment 322 may have a mounting surface 342 that is mountable to the flat surface, or to an optional base member that may, in turn, be mounted to the flat surface. The first segment 322 may also have a support surface 344 to which the corresponding tile of the tiles 110 (for example, the first tile 112 as in FIG. 3) may be mounted. The first segment may have a first end 352 and a second end 354; the first segment 322 may have a wedge shape such that the first end 352 is thicker than the second end 354. Thus, when the first tile 112 is mounted on the support surface 344, the first tile 112 may be angled relative to the mounting surface 342, and therefore, angled relative to the flat surface.

If desired, the first segment 322, or a portion thereof (such as the support surface 344) may be coated with a coating that performs a function such as enhancing the look and/or feel of the first segment 322, providing enhanced bonding of the first segment 322 to tile, to a base member, and/or to a flat surface, enhancing the structural strength of the first segment 322, and/or providing application-specific benefits such as water impermeability or antimicrobial characteristics. If a support structure with multiple support surfaces that are all formed as a single piece, such a coating may be applied to the entire support structure, or just to the individual support surface.

Such a coating may include any of a wide variety of coatings known in the art of construction, and more specifically, tile setting. According to one example, the coating may be ECO Prim Grip, made by Mapei (mapei.com).

Figure 4:
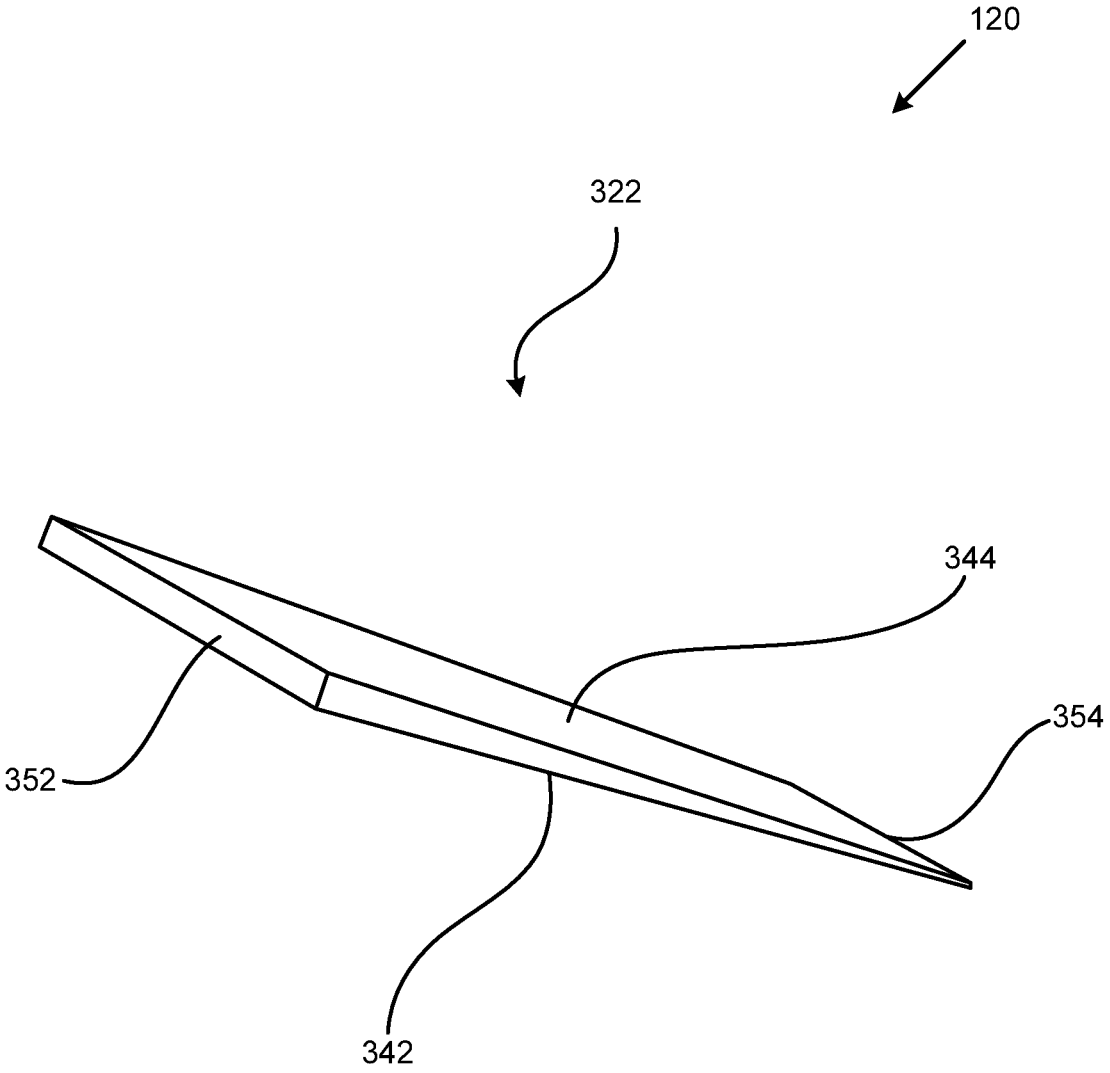
FIG. 4 is a perspective view of a segment of the support structure of the system of FIG. 1.

Referring to FIG. 4, a perspective view illustrates the first segment 322 of the support structure 120 of the system 100 of FIG. 1. FIG. 4 illustrates the wedge shape of the first segment 322. If desired, the mounting surface 342 and the support surface 344 of the first segment 322 may each have a parallelogram structure that matches that of each of the tiles 110.

Each of the segments may be secured directly to the flat surface, or to an optional base member (not shown) of the support structure 120. The base member may be designed to receive multiple segments. Such a base member may take the form of a rectangular prism with a uniform thickness.

If such a base member is used, it may be large enough to support all of the tiles 110 of the system 100, or only a predetermined number of the tiles 110. For example, each base member may be sized to receive four segments and thus, four tiles; the appropriate number of base members (e.g., three for the system 100 of FIG. 1) may simply be attached to the flat surface side-by-side to provide the desired size for the system 100.

The support structure 120 may be formed of any material known in the art for supporting tile, including but not limited to backer board, foam, plywood, sheetrock, wire mesh, acrylic, and/or combinations of the foregoing. If the flat surface to which the system 100 is to be mounted is a vertical surface or ceiling, the material used to form the support structure 120 may not be designed to bear heavy loads. According to some embodiments, the material used to form the support structure 120 may be a foam product known in the art, such as three-pound foam.

Conversely, if the flat surface is a floor, the top surface of a shower bench, or the like, the support structure 120 may be formed of a material designed to bear loads, and in particular, the loading induced by the weight of one or more people walking, sitting, or otherwise resting on the support structure 120. If used for flooring, the three-dimensional aspect of the systems of the present invention may provide some benefits such as increased traction, enhanced fluid drainage, or the like.

Additionally, the support structure 120 may have (or may be modified to have) a thickness that is larger, at least in some regions, than the thickness levels typically used for tile backing systems. The added thickness may provide the support structure 120 with enhanced effectiveness as a thermal insulator. If desired, the support structure 120 may be designed and/or positioned to provide insulation in a region in which it is needed. For example, the thicker regions of the support structure 120 may be positioned to cover voids in the insulation behind a wall, floor, or ceiling, or to cover a pipe that should desirably be protected against freezing temperatures.

The system 100 may be constructed in a modular fashion. For example, a user may first determine the area of the flat surface that is to be covered with the system 100. Then, the user may calculate the number of base members needed to cover that area. In the alternative, if the base members are omitted in favor of direct attachment of the segments to the flat surface, the user may calculate the number of segments that are needed to cover that area.

In alternative embodiments, a system according to the invention need not be designed for modular construction. For example, a support structure according to an alternative embodiment may have only a single piece with multiple support surfaces formed thereon. The single piece may be formed such that the support surfaces have the desired depth variation and/or angular variation. Such a support structure may be molded, machined, hand-carved, stamped, or otherwise manufactured.

Tiles and/or a support structures may be packaged and sold as a kit. A kit according to the invention may include support structures and/or one or more tiles. The support structure may include a plurality of segments. Additionally, the support structure may include a support member on which the segments are already mounted or can be mounted by the purchaser. In the alternative, the support structure(s) within the kit may each have only a single piece, each of which has multiple support surfaces formed thereon to receive the tiles.

As mentioned previously, the present invention may be used in a wide variety of settings. In particular, a system according to the invention, such as the system 100 of FIG. 1, may be used for any flat surface or combination of flat surfaces for which ornamental design is desired.

Figure 5:
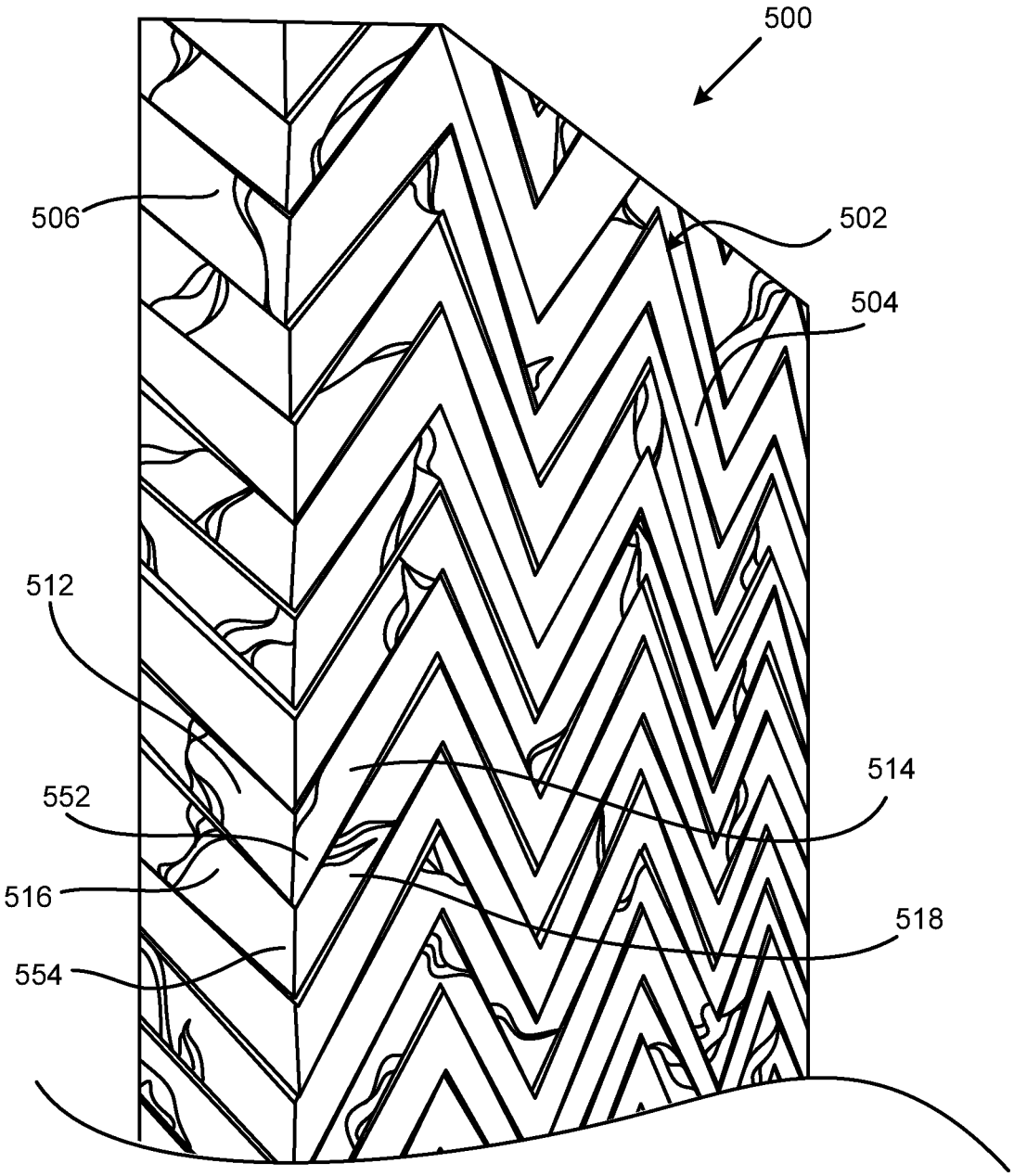
FIG. 5 is a perspective view of a system according to another alternative embodiment of the invention.

Referring to FIG. 5, a perspective view illustrates a system 500 according to another alternative embodiment of the invention. The system 500 may have chevron shapes like those of FIG. 1, but may be applied to a fireplace column 502.

The fireplace column 502 may include a front panel 504 and side panels 506. Thus, the fireplace column 502 may provide a three-dimensional shape on which the chevron pattern is to be displayed. The manner in which adjacent tiles join at junctions with varying depth levels is set forth in the description of FIG. 1. Similar principles may be used to provide junctions where tiles mounted to different flat surfaces (such as the front panel 504 and side panels 506) are joined.

More precisely, the front panel 504 and the side panel 506 shown in FIG. 5 may be joined at a ninety-degree angle. The system 500 may need to cover the angle in a manner that maintains the appearance of the chevron pattern. In order to accomplish this, the edges of the tiles attached to the front panel 504 that protrude outward proximate the side panel 506 may be aligned with the edges of the tiles attached to the side panel 506 that protrude outward. Similarly, the edges of the tiles attached to the front panel 504 that are recessed inward proximate the side panel 506 may be aligned with the edges of the tiles attached to the side panel 506 that are recessed inward.

For example, the system 500 may have a first tile 512 mounted to the side panel 506 and a second tile 514 mounted to the front panel 504. The first tile 512 and the second tile 514 may be joined together at a junction 552. Similarly, the system may also have a third tile 516 mounted to the side panel 506 and a fourth tile 518 mounted to the front panel 504. The third tile 516 and the fourth tile 518 may be joined together at a junction 554. The first tile 512 and the second tile 514 may, combined, form a chevron shape, and may be mirror images of each other across a plane passing through the junction 552. Since the front panel 504 and the side panel 506 may be angled ninety degrees apart from each other, the plane of symmetry may be angled forty-five degrees relative to each of the front panel 504 and the side panel 506. The third tile 516 and the fourth tile 518 may similarly combine to define a chevron shape with symmetry across the same plane.

The present invention is not limited to mounting on items with a rectangular prism shape. Rather, those of skill in the art, with the aid of the present disclosure, may understand how to mount three-dimensional tile patterns on a wide variety of three-dimensional shapes. Such three dimensional shapes may have flat surfaces angled relative to each other at angles other than ninety degrees. In some alternative embodiments, a system according to the invention may be mounted to a non-flat shape such as a cylindrical or other curved shape. In yet other alternative embodiments, a system according to the invention may be mounted to a three-dimensional structure having a combination of flat and rounded surfaces.

Figure 6:
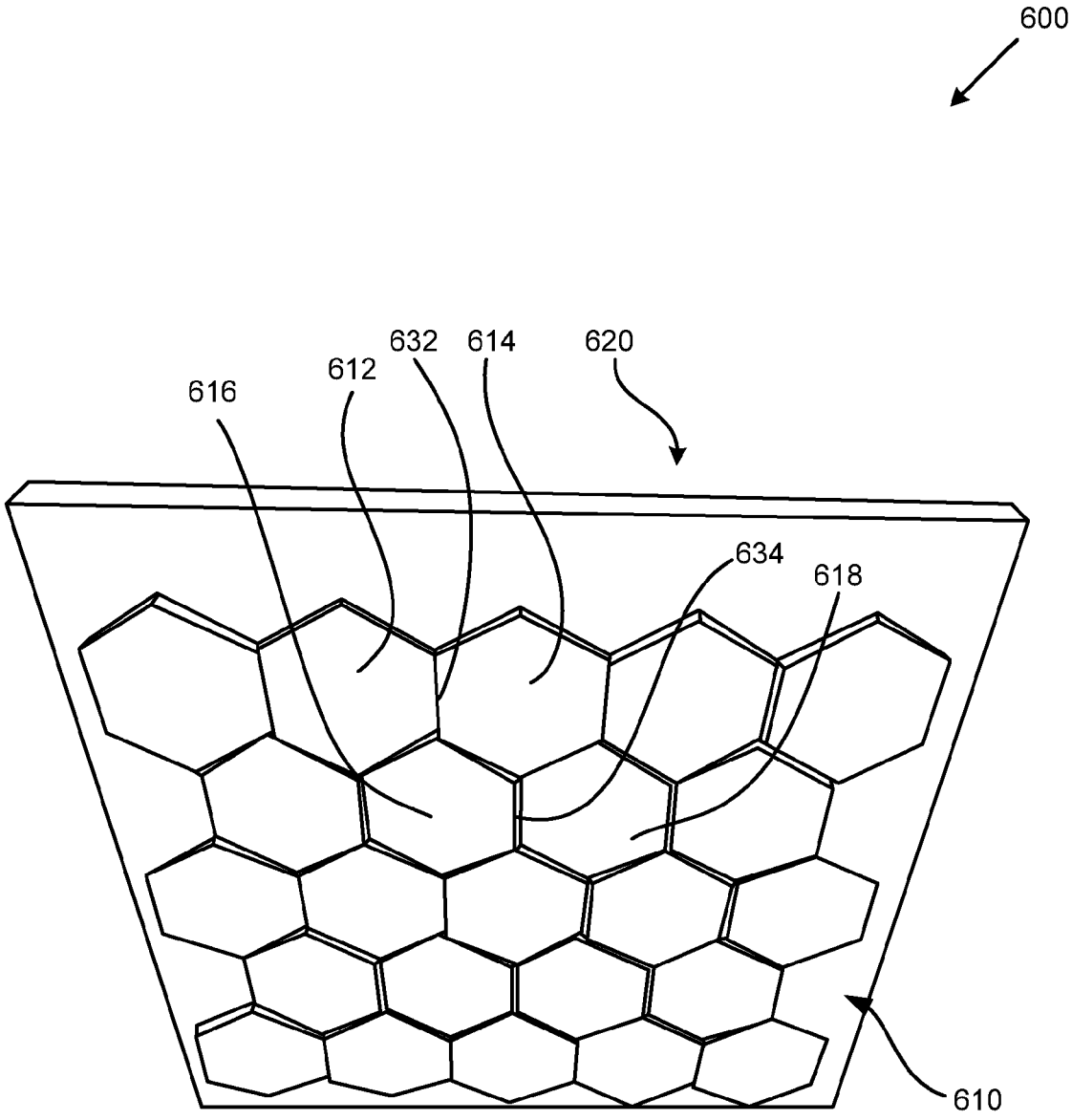
FIG. 6 is a perspective view of a system according to another alternative embodiment of the invention.
Figure 7:
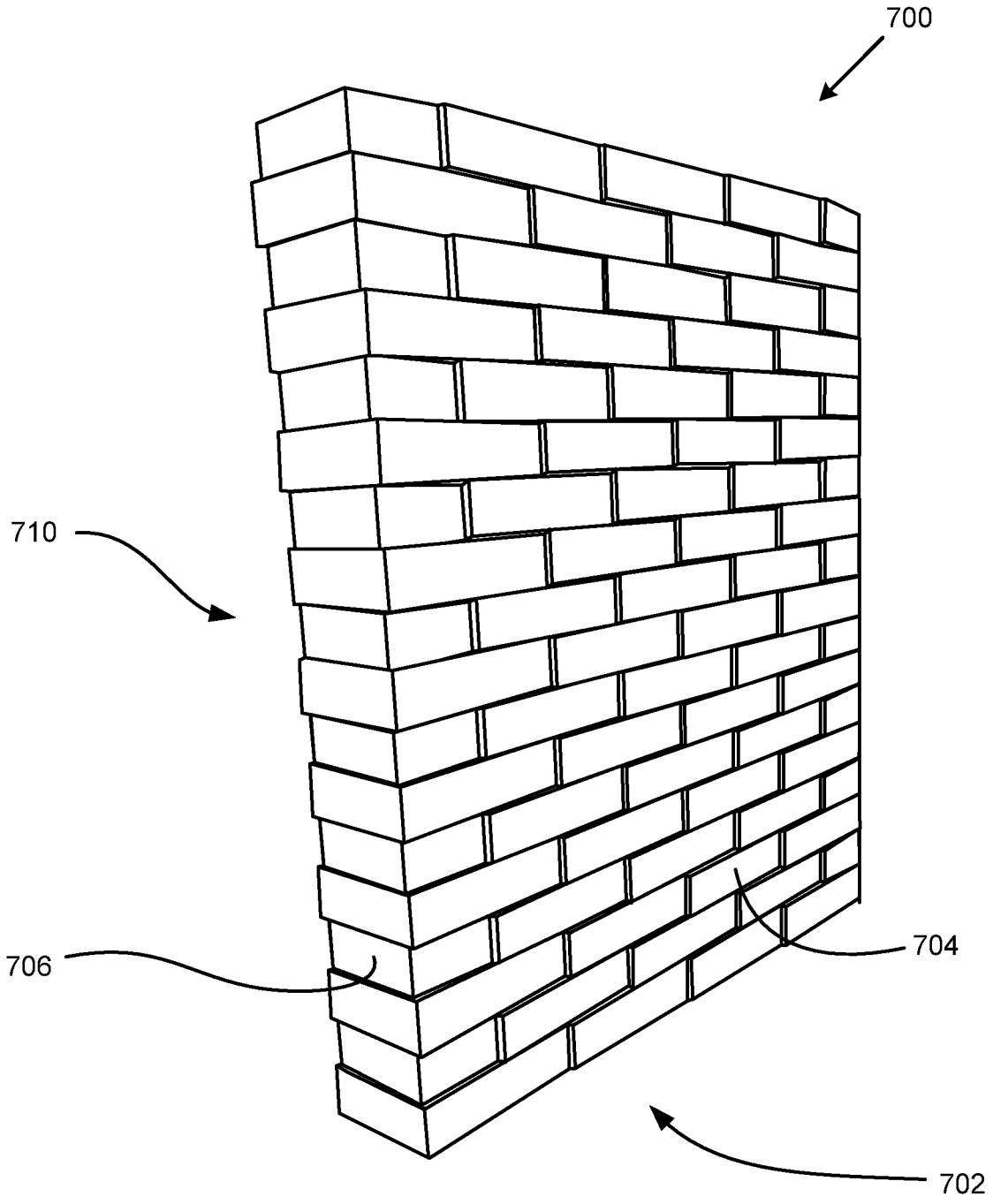
FIG. 7 is a perspective view of a system according to yet another alternative embodiment of the invention.

As also mentioned previously, the present invention may be used with tiles having a wide variety of shapes. FIGS. 6 and 7 will show examples in which the principles of the present invention are applied to tiles with shapes other than the parallelogram shapes of the system 100 of FIG. 1, the system 200 of FIG. 2, and the system 500 of FIG. 5.

Referring to FIG. 6, a perspective view illustrates a system 600 according to another alternative embodiment of the invention. The system 600 may include a plurality of tiles 610 and a support structure 620 that may be used to mount the tiles 610 to a flat surface (not shown).

The tiles 610 may be hexagonal in shape. Thus, the tiles 610 may be positioned such that, at each interior point of the pattern, three of the tiles 610 are joined. The support structure 620 may have a plurality of support surfaces (not shown) that are also hexagonal in shape, and possess angular variation relative to each other. Thus, the tiles 610 may be placed at a variety of angles relative to the flat surface.

More specifically, the tiles 610 may include a first tile 612 and a second tile 614 that are on the same row (i.e., the top row) and join at a junction 632. The first tile 612 and the second tile 614 may both be positioned at the same angle relative to the flat surface. Thus, the first tile 612 and the second tile 614 may not be positioned to be mirror images of each other. Instead, the left edge of each of the first tile 612 and the second tile 614 may protrude from the flat surface, while the right edge of each of the first tile 612 and the second tile 614 may be relatively recessed. This may cause the junction 632 to appear as a distinct vertical line when viewed from the left-hand side (e.g., a viewer viewing the system 600 from the left margin of the page of FIG. 6). Conversely, when viewed from the right-hand side, the junction 632 may be barely distinguishable.

Similarly, the tile 610 may include a third tile 616 and a fourth tile 618 that are on the same row (i.e., the second-to-top row) and join at a junction 634. The third tile 616 and the fourth tile 618 may both be positioned at the same angle relative to the flat surface, which may be opposite to the angle at which the first tile 612 and the second tile 614 are positioned. Thus, the right edge of each of the third tile 616 and the fourth tile 618 may protrude from the flat surface, while the left edge of each of the third tile 616 and the fourth tile 618 may be relatively recessed. This may cause the junction 632 to appear as a distinct vertical line when viewed from the right-hand side (e.g., a viewer viewing the system 600 from the right margin of the page of FIG. 6). Conversely, when viewed from the left-hand side, the junction 632 may be barely distinguishable.

This effect may serve to capture the attention of a viewer, particularly as he or she moves relative to the system 600. Motion attracts the eye, and the illusion of motion on the tiles 610 of the system 600 may help to highlight the flat surface to which the system 600 is mounted. Thus, texture, shadow, shapes, reflection, and/or light may be used to capture or enhance the look and feel of a particular space.

Referring to FIG. 7, a perspective view illustrates a system 700 according to yet another alternative embodiment of the invention. The system 700 may include a plurality of tiles 710 mounted to a dividing wall 702 with a front surface 704, a side surface 706, and a rear surface (not visible). The tiles 710 may be mounted to a support structure (not shown) which, in turn, is mounted to the dividing wall 702.

As shown, each of the tiles 710 may have a generally rectangular shape. The tiles 710 may lend the dividing wall 702 the appearance of a brick wall. The tiles 710 mounted to the front surface 704 may all be positioned at substantially the same angle so that each row of tiles 710, when viewed from the top or bottom, has a saw tooth profile. The tiles 710 mounted to the front surface 740 may all be angled away from the side surface 706 so that, for a person viewing the system 700 from proximate the side surface 706, the junctions between adjacent tiles of the tiles 710 within the same row may appear as vertical lines, which may make the bricklike appearance more distinct. In alternative, the tiles 710 may be angled toward the side surface 706 so as to accentuate their appearance form a viewer positioned closer to the end (not shown) of the front surface 704 opposite to the side surface 706.

If desired, the tiles 710 mounted on the front surface 704 that are adjacent to the side surface 706 may not be angled, but may instead be positioned parallel to the front surface 704. The tiles 710 mounted on the side surface 706 may be positioned parallel to the side surface 706, or may be angled so as to maintain the appearance of bricks with edges angled at ninety degrees.

Figure 8:
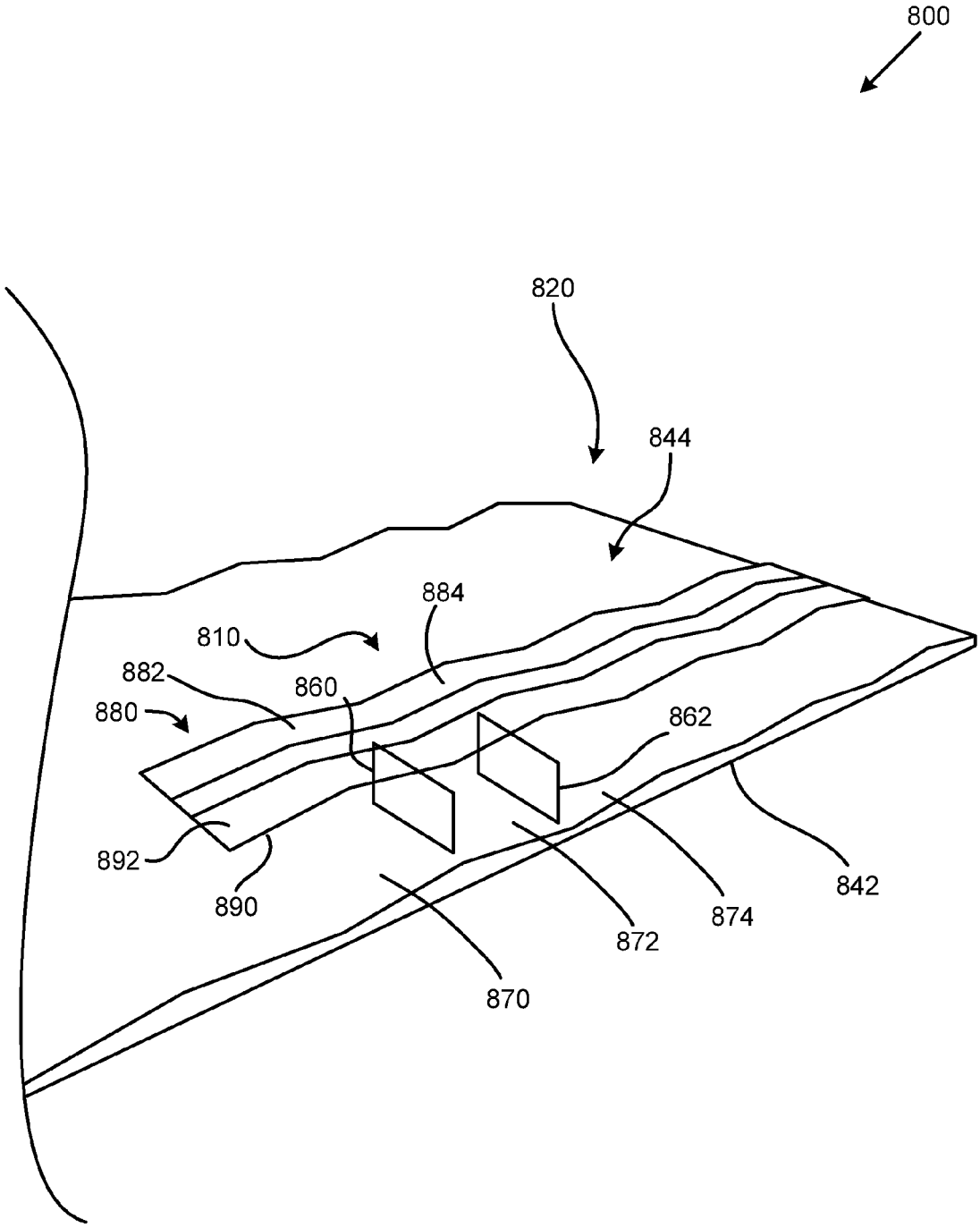
FIG. 8 is a perspective view of a system according to still another alternative embodiment of the invention.

Referring to FIG. 8, a perspective view illustrates a system 800 according to still another alternative embodiment of the invention. The system 800 may include a plurality of tiles 810 and a support structure 820 that may be used to mount the tiles 810 to a flat surface (not shown). The support structure 820 may have a mounting surface 842 that will be mounted to the flat surface to which the system 800 will be attached, and a plurality of support surfaces 844 that receive the tiles 810.

As shown, the support surfaces 844 may be angled with minor symmetry relative to each other across planes that are perpendicular to the mounting surface 842, and thus perpendicular to the flat surface to which the system 800 will be attached. For example, the support surfaces 844 may have a first support surface 870, and second support surface 872, and a third support surface 874. The support surfaces 844 may be oriented such that the second support surface 872 is substantially a mirror image of the first support surface 870 across a first plane 860, and the third support surface 874 is substantially a mirror image of the second support surface 872 across a second plane 862.

The second support surface 872 may be angled relative to the first support surface 870 to define a peak between the first support surface 870 and the second support surface 872. The third support surface 874 may be angled relative to the second support surface 872 to define a trough between the second support surface 872 and the third support surface 874. Alternating support surfaces 844 may be parallel to each other; thus, for example, the first support surface 870 may be parallel to the third support surface 874.

The tiles 810 may include a first tile 880 mounted to the first support surface 870, a second tile 882 mounted to the second support surface 872, and a third tile 884 mounted to the third support surface 874. The tiles 810 may each have a uniform thickness that is the same for all of the tiles 810. Each of the tiles 810 may thus have a mounting surface 890 mountable to the corresponding support surface of the support surfaces 844 and an exterior surface 892 that is parallel to the mounting surface 890. The exterior surfaces 892 of the first tile 880, the second tile 882, and the third tile 884 may thus have the same minor symmetry and parallel relationships with each other as those of the first support surface 870, the second support surface 872, and the third support surface 874, as set forth above.

This may provide the system 800 with a contour that presents varying shapes and/or patterns to the user as the user changes his or her viewing angle relative to the system 800. If desired, every other tile may have a first color or pattern, while the intervening tiles have a second color or pattern. For example, the first tile 880, the third tile 884, and each tile parallel to the first tile 880 and the third tile 884 may be red, while the second tile 882 and each tile parallel to the second tile 882 may be blue. Thus, a user viewing the system 800 form a vantage point to the extreme left, relative to the view of FIG. 8, may see the system 800 as a red wall, while another user viewing the system 800 from a vantage point to the extreme right may see the system 800 as a blue wall. Users viewing the system 800 from viewpoints in between these extremes may see a wall with red and blue stripes, with colored stripes that vary in relative width depending on the viewing angle.

The support structure 820 may be formed of a single piece so that all of the support surfaces 844 are cut or otherwise formed in a single piece of material. Alternatively, the support structure 820 may be formed by providing a plurality of support blocks, each of which has one of the support surfaces 844 thereon. For example, the support structure 820 may be formed as a plurality of support blocks including a first support block having the first support surface 870, a second support block having the second support surface 872, and a third support block having the third support surface 874. The support blocks may be secured together, for example, by attaching the first, second, and third support blocks together at the first plane 860 and the second plane 862 to form the support structure 820.

Alternatively, the support structure 820 may be formed from a plurality of support blocks, each of which has more than one of the support surfaces 844 formed thereon. For example, the first support surface 870 and the second support surface 872 may be part of a single support block with a peaked shape. The third support surface 874 may be part of a different support block that is attached to the support block having the first support surface 870 and the second support surface 872 at the second plane 862.

If desired, the support structure 820 may be formed of multiple support blocks as outlined above, which support blocks may be assembled by the user. Thus, the support structure 820 may be assembled on-site to fit the size and shape of the flat surface on which the support structure 820 is to be mounted. Support blocks divided in either schema provided above may easily nest together (for example, by positioning the peak of one support block into the valley of another) to facilitate packing and shipping.

As shown in FIG. 8, the support surfaces 844 of the support structure 820 may be arranged to define a one-dimensional array, i.e., pattern of support surfaces 844 that extends along only a single direction. If desired, one or more support structures 820 may be added to provide a two-dimensional array. For example, a support structure 820 like that of FIG. 8 may be placed adjacent to the support structure 820 of FIG. 8 such that the troughs of the second support structure 820 reside within the first plane 860, and the peaks of the second support structure 820 reside within the second plane 862. The resulting structure may alternatively be formed as a single piece.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A system for mounting a plurality of tiles on a flat surface, the system comprising:

a plurality of tiles, each of which comprises a mounting surface, an exterior surface, and peripheral edges; and a plurality of support structures mountable on the flat surface;

wherein the plurality of support structures are shaped such that when the plurality of support structures are mounted on the flat surface, the exterior surfaces of the plurality of tiles have a plurality of angled orientations, relative to the flat surface, wherein at least one junction is formed between two joining peripheral edges of the peripheral edges of adjacent tiles of the plurality of tiles, wherein the two joining peripheral edges are at different depths, wherein depth is measured as distance from the flat surface;

wherein the plurality of support structures comprises at least a first support structure adjacent to a second support structure, wherein the first support structure comprises a first planar support surface that is coupled to and shaped to support the mounting surface of at least one of the plurality of tiles and the second support structure comprises a second planar support surface that is adjacent to and nonparallel to the first planar support surface, and is coupled to and shaped to support the mounting surface of at least one of the plurality of tiles;

wherein the second planar support surface is oriented and positioned such that, across a plane perpendicular to the flat surface, the second planar support surface is substantially a mirror image of the first planar support surface.

2. The system of claim 1, wherein the plurality of support surfaces further comprises:

a third support surface adjacent to the first support surface; and a fourth support surface adjacent to the second support surface and the third support surface;

wherein the fourth support surface is oriented and positioned such that, across the plane, the fourth support surface is substantially a minor image of the third support surface, wherein the third support surface is substantially parallel to the second support surface and the fourth support surface is substantially parallel to the first support surface.

3. The system of claim 1, wherein each of the first and second support surfaces comprises a parallelogram shape such that, combined, the first and second support surfaces define a chevron shape.

* * * * *